United States Patent [19]

Hodges et al.

[11] 4,385,700

[45] May 31, 1983

[54] DIFFERENTIAL REFLECTIVITY METHOD AND APPARATUS FOR SORTING STRIP ITEMS

[75] Inventors: Joseph L. Hodges; Norman B. Wassmer, both of Ontario, Oreg.; Paul R. Myers, Caldwell, Id.

[73] Assignee: Ore-Ida Foods, Inc., Boise, Id.

[21] Appl. No.: 254,476

[22] Filed: Apr. 15, 1981

Related U.S. Application Data

[63] Continuation of Ser. No. 89,965, Oct. 31, 1979, abandoned.

[51] Int. Cl.[3] ..... B07C 5/00

[52] U.S. Cl. ..... 209/539; 209/582; 209/587; 209/657; 209/540; 250/222.1; 198/446

[58] Field of Search ..... 209/576, 914, 920, 923, 209/582, 587, 657, 658, 934, 539, 540; 250/222 R; 198/382, 383, 396, 688, 445, 446; 193/46

[56] References Cited

U.S. PATENT DOCUMENTS

| | | | |
|---|---|---|---|
| 1,719,125 | 7/1929 | Finn | 198/688 X |
| 3,255,864 | 6/1966 | Oldershaw et al. | 198/383 X |
| 3,365,047 | 1/1968 | Schmitz | 198/383 |
| 3,545,610 | 12/1970 | Kelly | 209/920 X |
| 3,702,655 | 11/1972 | Cox | 209/920 X |
| 3,799,336 | 3/1974 | Holman | 209/543 |
| 3,834,308 | 9/1974 | Moggio | 198/688 X |
| 4,049,111 | 9/1977 | Mosterd | 198/445 |
| 4,074,807 | 2/1978 | Goulds | 198/445 |

*Primary Examiner*—Allen N. Knowles

*Attorney, Agent, or Firm*—Mallinckrodt & Mallinckrodt

[57] ABSTRACT

Apparatus for sorting slender elongate items, some of which are defective, includes a viewing area with sensing means that sense defects in the items and produces a signal when a defect is sensed, and a removal area with removal means that operate in response to the signals from the sensing means to remove defective items. A conveyor having upstanding walls defining a series of longitudinal side by side channels receives a flow of randomly oriented items and places them in substantially singulated end to end alignment. An endless belt conveyor is arranged as a longitudinal continuation of the first conveyor and has a series of troughs aligned with the series of channels for receiving the substantially singulated and aligned items from the channels of the first conveyor and for carrying the received items through the viewing area and into the removal area in substantially singulated end to end alignment.

11 Claims, 21 Drawing Figures

2
38
45
48
47
36
46
50
43
44
47
50
43
37
20
38a
40
42
41
61
60
71
135
135
62
62e
39
49
42
44
31
60
201
30
32
53a
53
24
52
125
25
27
26
81
29
92
93
75a
80
20b
55
54
20d
79a
172
169
170
2
39a
33
40a
41
40
33
20
38
20

DIFFERENTIAL REFLECTIVITY METHOD AND APPARATUS FOR SORTING STRIP ITEMS

This is a continuation, of application Ser. No. 089,965, filed Oct. 31, 1979, now abandoned.

BACKGROUND OF THE INVENTION

1. Field

The invention is in the field of apparatus and methods for automatically sorting items and for removing those items which do not conform to predetermined standards. It is specifically concerned with the automatic sorting of elongate items, particularly food items, such as elongate strip potato pieces cut from peeled, raw, white potatoes in the production of commercially prepared food products, such as french fries, to eliminate those of such items as are defective.

2. State of the Art

There are numerous machines described in the patent literature for sorting such items as fruits and vegetables. Many of these machines use light sources to illuminate the items to be sorted. In some cases the translucence of an item is a measure of its condition, defective items exhibiting different translucence than sound items. In such cases, light sensors are arranged to detect the light transmitted by the items being sorted. In other cases, the amount of light reflected from an item is a measure of its condition. In the latter cases, sensors are arranged to detect reflected light. In still other cases, the color of an item indicates its condition. In such other cases, reflected light of a certain wavelength is detected by light sensors, and associated filters are provided to pass to the sensors only reflected light of that wavelength.

In U.S. Application Ser. No. 895,256, filed Apr. 10, 1978 by two of the present inventors, Norman Brent Wassmer and Joseph L. Hodges, entitled "Differential Reflectivity Method and Apparatus for Sorting Indiscriminately Mixed Items", now U.S. Pat. No. 4,186,836, issued Feb. 5, 1980, there is disclosed a system for automatically sorting items of the nature of cubed, raw, white potatoes by passing such items, first, through a viewing area and, then, through a removal area as a continuous heterogeneous bed substantially no thicker than the thickness of the individual items. The potato cubes are indiscriminately mixed and the bed has considerable width relative to the width of the individual items.

An endless belt conveyor carries the bed through the viewing area, where it is flooded with radiant energy (made up of visible light energy and infrared energy) from light fixtures which extend along the width of the viewing area and produce an integrated spread of the radiant energy throughout the viewing area.

The indiscriminately mixed cubes making up the bed reflect the component radiant energies of mutually different wavelengths in respectively different degrees, depending upon condition of the individual cubes. The potato cubes reflect such energies according to a predetermined relationship if there are no dark spots attributable to defects of various kinds. If there are such dark spots, the energies will be reflected in other than the predetermined relationship.

The respective energies reflected from the bed passing through the viewing area are individually sensed by pairs of sensing devices, e.g. pairs of diodes of a dual diode array scanning camera, which is focused on respective, contiguous, sub-areas of the viewing area extending transversely of the bed. Signals from the sensing devices of each pair are compared, e.g. by comparison circuitry of the scanning camera. Data signals result if the comparison of sensed signals show that the predetermined relationship between reflected energies exists for particular sub-areas of the viewing area. These control the operation of removal devices in the removal area.

The removal devices are suction tubes arranged across the width of the removal area. They have respective widths corresponding in widths and locations with predetermined pluralities of the sub-areas of the viewing area, so that any width portion of the bed passing through the removal area for which a predetermined number of data signals are produced will be removed.

The removal devices are individually operated by respective pneumatically actuated, power piston and cylinder assemblies controlled by data signal processing means, such as sophisticated electronic circuitry and data processing components.

U.S. Pat. No. 3,675,769, issued July 11, 1972, discloses a sorting system that detects ratios of reflected light of two wavelength ranges in order to differentiate between field-dug potatoes and rocks and dirt clods as the potatoes are being harvested. With this system, as with the aforementioned color sorting systems which detect light within restricted wavelength ranges, the individual items to be sorted are arranged in side by side rows, along which they are passed single file and are viewed individually as they pass.

However, there is nothing in the prior art which suggests how cut potato strips or similar slender elongate items should be handled to achieve sorting results similar in effectiveness to the results achieved by the aforesaid U.S. Application Ser. No. 895,256.

SUMMARY OF THE INVENTION

In accordance with the present invention, slender, elongate, strip items to be sorted, such as cut, french fry, potato pieces, are substantially singulated and aligned, end to end as by being fed randomly oriented in a flow of such items from a shaker feeder tray to a second shaker feeder tray which has walls dividing the tray into a plurality of channels running in the direction of travel of items on the tray. A plurality of longitudinal trough-like grooves preferably two, are located at the bottom of each channel. As the tray vibrates, most of the strip items fall into the channels and tend to align themselves single file in the grooves. Fingers may project from the top of some of the walls to help direct strips that straddle a number of the walls into one or another of the channels.

The strip items fall from the grooves of such second shaker feeder tray onto a conveying belt that has trough-like grooves corresponding to the grooves in the tray. These grooves tend to keep the strip items aligned in single file. It is preferred that the belt travel at a speed to convey the strip items faster than they are conveyed by the feeder tray, thereby tending to further singulate the items as they fall from the tray to the belt.

In the sorting system disclosed by the aforesaid U.S. application Ser. No. 895,256, which is the preferred system utilized in connection with the present invention, the conveyor carries the items through a viewing area where they are flooded with radiant energy of two mutually different wavelengths, e.g. visible light energy and infrared energy, from light fixtures extending along the width of the viewing area and producing an integrated spread of the radiant energy throughout the viewing area.

As previously indicated, in such a sorting system the items to be sorted reflect energies of mutually different wavelengths in respectively different degrees, depending upon the respective conditions of the individual items. The potato strips reflect such energies according to a predetermined relationship if there are no dark spots attributable to defects of various kinds. If there are such dark spots, the energies will be reflected in other than the predetermined relationship. The respective energies reflected from the strips passing through the viewing area are individually sensed, resulting signals are compared, and resulting data signals are used to control the operation of potato removal devices in the removal area.

In the present system, the potato removal devices are a series of deflectors arranged across the width of the removal area, the component deflectors having widths approximately corresponding in extent and location with the grooves of the belt, respectively, so that, as in the previous system, any width portion of the total side by side flows of aligned potato strips passing through the removal area, for which a predetermined number of data signals are produced, will be removed. The deflectors are individually operated as in the previous system.

THE DRAWINGS

The best mode presently contemplated for carrying out the invention is shown in the accompanying drawings, in which:

FIG. 1 is a pictorial view of the apparatus of the invention;

FIG. 2, a fragmentary longitudinal vertical section taken along the line 2-2 of FIG. 1, an intermediate portion being broken out for convenience of illustration;

FIG. 3, a fragmentary transverse vertical section taken along the line 3—3 of FIG. 2, an intermediate portion being broken out and supporting frame members not being shown;

FIG. 4, a transverse vertical section taken along the line 4—4 of FIG. 2, showing the complete height of the apparatus but with an intermediate portion being broken out;

FIG. 5, a fragmentary end elevation viewed from the standpoint of the line 5—5 of FIG. 2, an intermediate portion being broken out;

FIG. 6, a fragmentary vertical section taken along the line 6—6 of FIG. 4, showing the camera and its mount, the cover portion of the housing being removed;

FIG. 7, a top plan view taken from the standpoint of the line 7—7 of FIG. 6, but with the camera removed so that only the camera mount is shown;

FIG. 8, a fragmentary horizontal section taken along the line 8—8 of FIG. 4 and drawn to a larger scale, an intermediate portion being broken out;

FIG. 9, a fragmentary end elevation taken from the standpoint of the line 9—9 of FIG. 8 and drawn to a smaller scale;

FIG. 10, a fragmentary transverse vertical section taken along the line 10—10 of FIG. 8 and drawn to a slightly larger scale, an intermediate portion being broken out;

FIG. 11, a fragmentary longitudinal vertical section taken along the line 11—11 of FIG. 10, and showing the utility unit latching mechanism;

FIG. 12, a transverse vertical section of the utility unit taken on the line 12—12 of FIG. 8, showing none of the structure apart from the utility unit, an intermediate portion being broken out;

FIG. 13, a fragmentary perspective view of a portion of the conveyor belt showing surface features of the belt;

FIG. 14, a fragmentary longitudinal vertical section taken along the line 14—14 of FIG. 4, showing the utility unit of the apparatus in place, the view being drawn to a larger scale and maintenance positions of the lighting fixtures being indicated by broken lines;

FIG. 15, a fragmentary transverse section taken along the line 15—15 of FIG. 14 and drawn to a larger scale to show details of the special lamp holders;

FIG. 16, a fragmentary top plan view of the special lamp holders taken from the standpoint of the line 16—16 of FIG. 15;

FIG. 17, a perspective view looking through the walls of the portion of the utility unit encircled by line 17—17 of FIG. 12, showing the piping for the cooling system;

FIG. 18, a fragmentary vertical section taken along the line 18—18 of FIG. 17;

FIG. 19, a fragmentary end elevation similar to FIG. 5, showing the removal means, but drawn to a larger scale and not showing the conveyor belt, the valve cover being partially broken away and an intermediate portion of the unit being broken out;

FIG. 20, a fragmentary longitudinal vertical section taken along the line 20—20 of FIG. 19; and FIG. 21, a fragmentary longitudinal vertical section taken along the line 21—21 of FIG. 19, to show the removal means latching mechanism.

DETAILED DESCRIPTION OF THE ILLUSTRATED EMBODIMENT

Figures 1, 3:
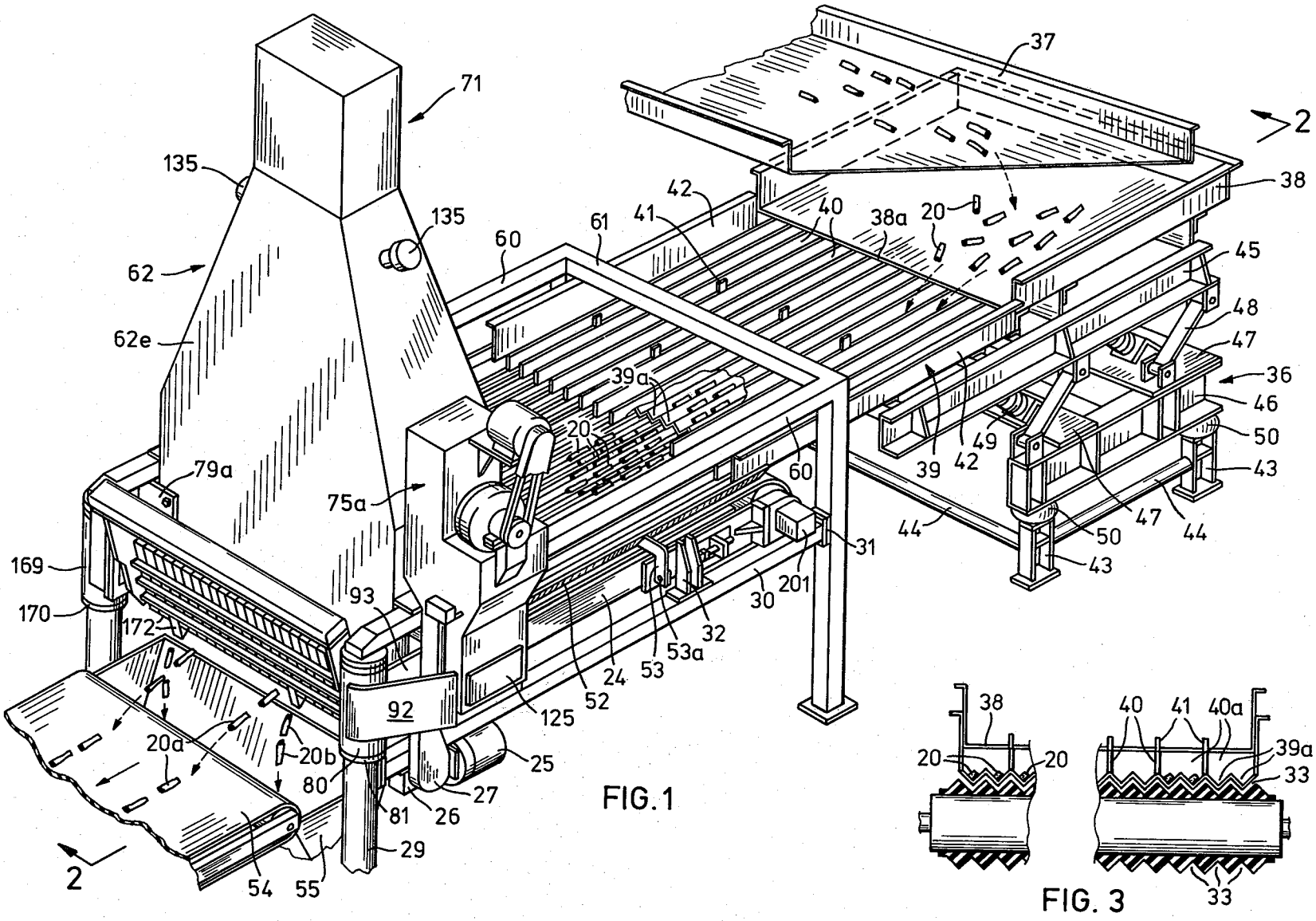

In the particular form illustrated, see particularly FIG. 1, the apparatus of the invention is adapted to sort elongate, french fry strips 20 cut from peeled, raw, white potatoes, removing those that are defective, e.g. those containing dark spots, from those that are sound. The latter, **20*a*, are discharged for further processing into various commercial frozen french fry products, while the former, 20*b***, are deflected and removed from the product stream.

Figure 2:
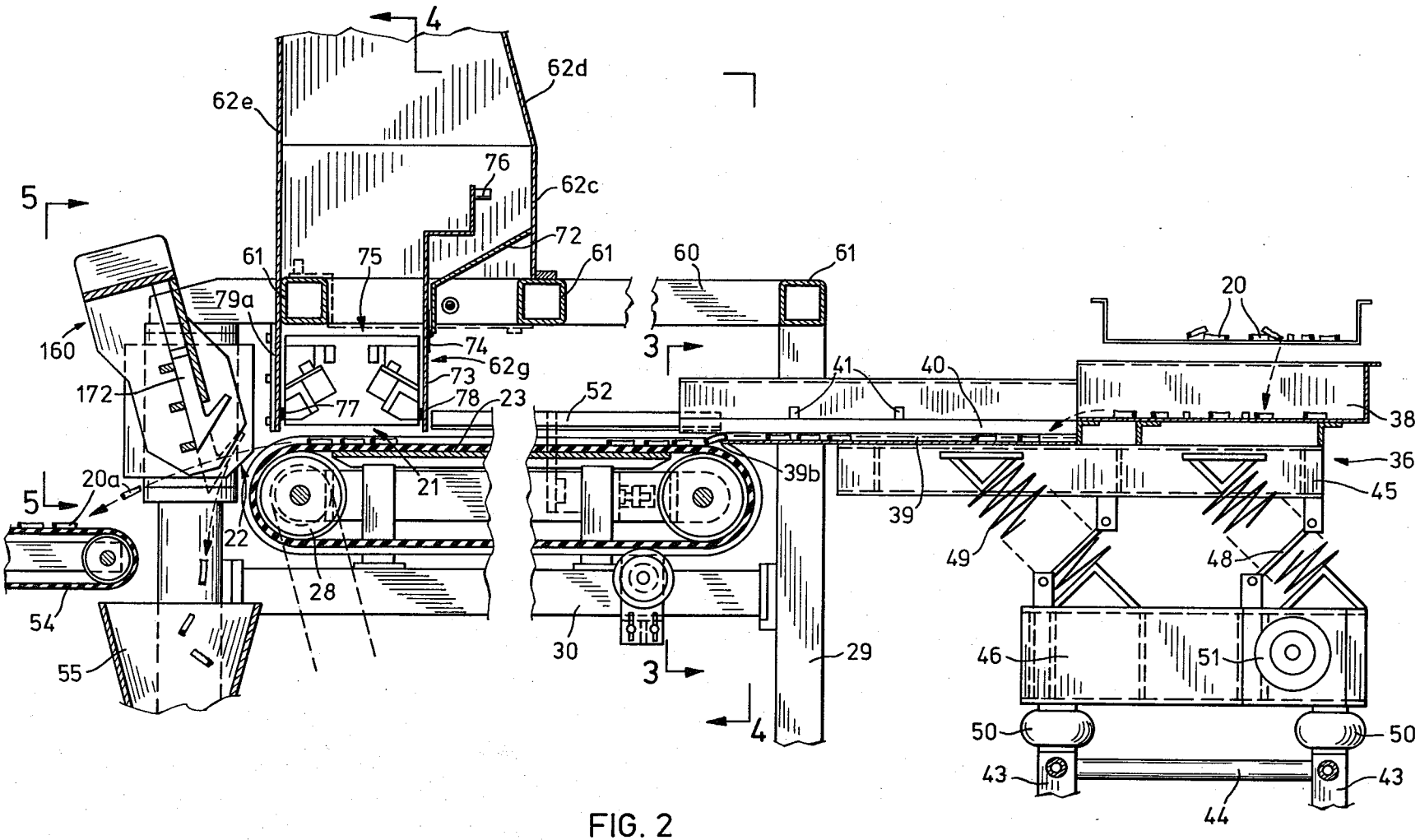

The mixed defective and sound potato pieces 20 are passed through a viewing area 21, FIG. 2, and thereafter through a removal area 22, by means of a conveyor belt 23 on which the potato pieces ride. Belt 23 is preferably of endless type used by food processors and is part of an endless conveyor having stationary frame sides 24 extending longitudinally of the belt, which is driven in usual manner by an electric motor 25, FIGS. 1 and 4, through a reduction gear box 26 and sprocket chain drive 27 powering head roller 28.

The entire apparatus is mounted on and supported by legs 29. Support bars 30 mounted on brackets 31 extend longitudinally between pairs of the legs 29 and serve to support standards 32 which carry the frame sides 24 of the conveyor.

Figures 4, 5, 6, 7:
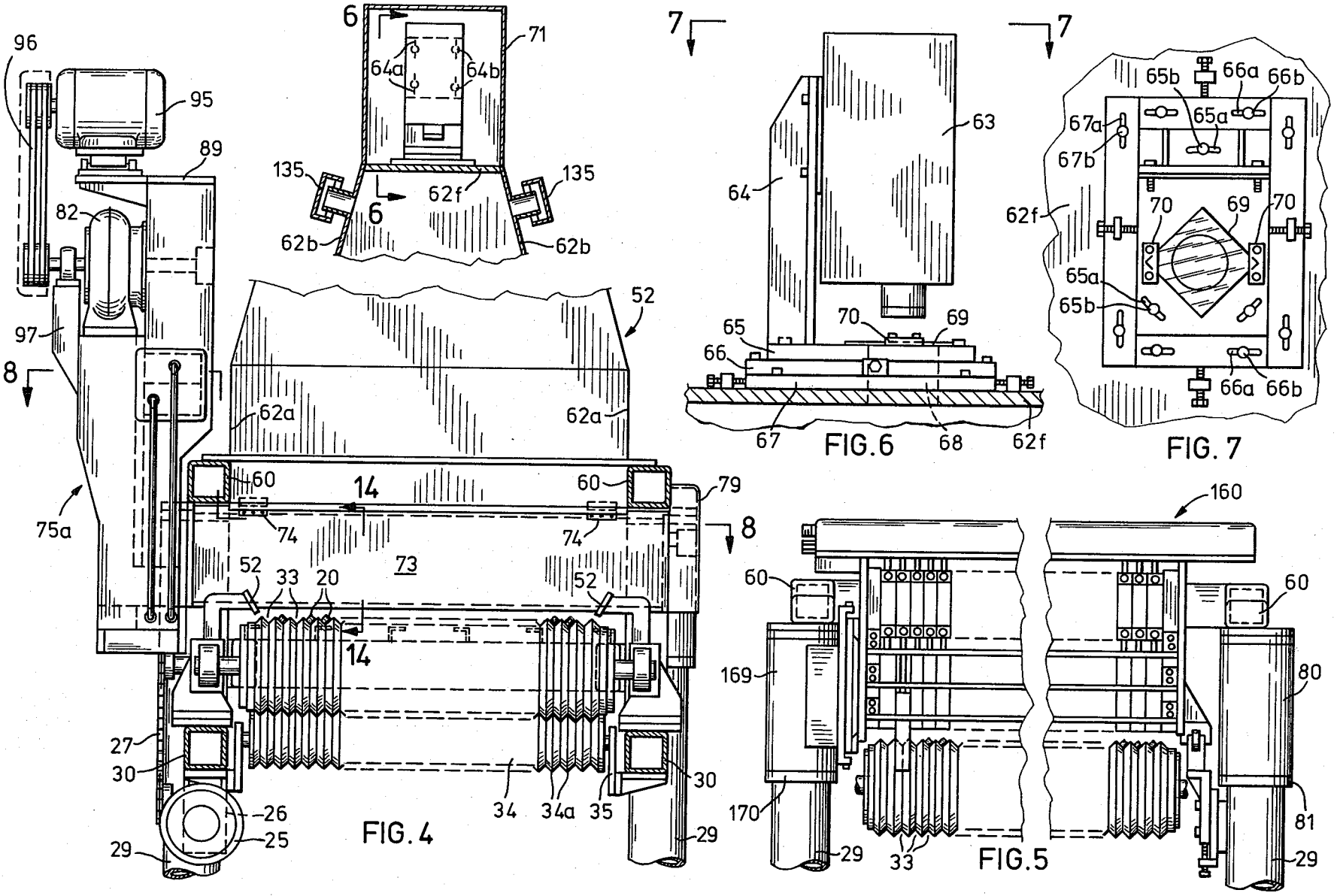

The working surface of belt 23 has a plurality of longitudinal trough-like grooves 33, FIGS. 3 and 4, molded thereinto. Preferably, the belt is corrugated to provide such grooves, and an idler roller 34, having ridges **34*a* therein adapted to mate with the grooves of the return run of the belt is mounted for rotation by brackets 35 secured to support bars 30. Corresponding idler roller 34 keeps belt 23** aligned and prevents it from moving laterally.

The cut potato pieces 20 are fed onto belt 23 in streams of substantially singulated and substantially longitudinally aligned elongate strips by a shaker feeder 36, FIGS. 1 and 2.

Cutting of raw whole potatoes into elongate, french fry strips following peeling of the potatoes may be accomplished by conventional means (not shown), the cut pieces being conveyed by conventional means, such as a shaker feeder 37, which discharges them onto feeder 36. Shaker feeder 36 has a first feeding tray 38 which receives the cut raw potato strips to be sorted. The vibration of feeder tray 38 distributes the potato pieces 20 fairly evenly over the width of the tray and moves them toward the discharge end 38*a* thereof, from where they fall by gravity onto a second feeder tray 39.

Feeder tray 39 has longitudinal trough-like grooves 39*a* therein which correspond to the grooves 33 in belt 23. Along every other ridge between the grooves is a longitudinal wall 40 that divides the tray 39 into a plurality of channels 40*a*. As the potato strips 20 fall from shaker tray 38 to shaker tray 39, the walls 40 tend to direct them into one or another of the channels where they tend to fall into and align themselves in one or the other of the grooves 39*a* of the channels as they travel toward the discharge end 39*b* of tray 39.

Extending from the top of a selected number of walls, preferably every other wall and intermediate its length, is a finger 41. Adjacent fingers are preferably located at different positions along the walls. The fingers catch potato strips that are straddling the walls and in most cases will cause the potato strips to fall into a channel 40*a*. It should be noted that the walls 40 are secured to the shaker tray so that they vibrate along with the tray, thereby causing the potato strips to move along the walls and to drop into the channels either before reaching fingers 41 or when reaching fingers 41. Fingers on every wall are not necessary because if a potato strip falls onto tray 39 and straddles only a single wall, it will usually fall into a groove due to the vibrating action of the wall. If the potato strips are limp, they will remain across the wall and move to the end where they fall off onto the belt, or if across a wall having a finger 41, will get hung up on the finger. In operation, very few strips get hung up on fingers 41, but those that do either break and fall off or are removed manually. Thus, not all strips will be directed into a channel, but most will.

During travel along shaker tray 39, the potato strips tend to arrange themselves in single file in each groove. Tray side walls 42 keep the potato strips from falling off the sides of the trays.

The shaker feeder tray 39 is located adjacent to the feed end of conveyor belt 23, but is located on a separate frame supported by legs 43 with bars 44 connecting adjacent legs. The shaker trays are mounted on supports 45 which are mounted for vibration in normal manner on supports 46 and cross plates 47 by links 48 and stabilizers 49. Supports 46 are mounted on legs 43 through airmounts 50. Motor 51 causes the trays to vibrate in normal manner to cause the potato strip pieces to be conveyed toward the discharge ends of trays 38 and 39. While it is preferred that the trays 38 and 39 be incorporated into a single shaker feeder unit, the two trays could be mounted separately for vibration or be separate but adjacent shaker units.

With the discharge end 39*b* of shaker tray 39 adjacent and just above the feed end of conveyor belt 23, the potato pieces falling off discharge end 39*b* of the shaker tray 39 fall onto belt 23. Since grooves 39*a* in shaker tray 39 correspond to grooves 33 in belt 23, most of the potato strips 20 will fall directly from a feeder groove into a belt groove and will continue on as part of a single-file stream of substantially aligned potato strips. The speed of travel of the belt is such that the potato strips on the belt travel faster than they do on the shaker tray 39. This increased speed tends to singulate the potato strips that have not been singulated by the shaker tray and to further separate those that have been singulated on the tray. Walls 40 extend beyond discharge end 39*b* of tray 39 so that they help keep the potato strips aligned as they fall from the tray to the belt.

Conveyor side wall pieces 52, swingably attached by brackets 53 to conveyor side plates 24 (FIGS. 2 and 4), extend longitudinally along conveyor belt 23 to ensure that the potato strips do not fall off the sides of the belt and that they remain on the portion of the belt where they are observed for defects. Such side wall pieces may be swung outwardly about bracket pivot point 53*a*, FIG. 1, so they are away from and do not rise above the level of belt 23. This would normally be done only during certain maintenance and cleaning procedures.

In the apparatus shown, using a belt thirty-five inches wide, with only the center thirty-two inches having grooves therein and carrying the product discharged from shaker feeder tray 39, which is also thirty-two inches wide, satisfactory product distribution on the shaker trays and on the belt and effective operation of the entire apparatus are obtained at a belt speed of about 360 feet per minute. At such speed, the apparatus has a capacity of approximately 10,000 pounds per hour of what are commonly called "shoestring cut potato strips," such strips being approximately one-quarter inch square in cross-section. If the strip pieces are larger, such as regular french fries which are approximately one-half inch square in cross-section, the poundage sorted is about double that indicated. This is because the number of strip pieces being sorted is the controlling factor, rather than the size of the pieces. The belt speed may of course vary over a wide range, being either less than or greater than that indicated. The speed indicated is currently preferred for high throughout of product with good sorting.

The belt speed upper limit depends upon the scan speed of the camera, the light available for illuminating the potato pieces, and the speed of the removal devices. With the apparatus shown and to be described, and with a belt speed of 360 feet per minute, the viewing means looks separately at about each one-tenth inch of the potato strip, so it can see a defect as small as one-tenth inch. The removal device can remove a one and one-half inch strip without removing other strips in the stream.

Viewing area 21, FIG. 2, comprehends a localized portion of the length of belt 23 over the entire width of the intermediate carrying portion thereof, and removal area 22 comprehends a localized portion of the length of the discharge area at the end of the belt over a width corresponding to the carrying portion of the belt. While passing through viewing area 21, the potato strip pieces 20 are subjected to scanning by sensing means adapted to individually sense reflected energies of different wavelengths. A predetermined amount of time later, which depends upon the speed of travel of belt 23 and the distance between the two areas, defective potato pieces are removed from the stream of potato pieces by removal means while the potato pieces are passing through removal area 22.

The sound potato strips 20*a* are discharged from the end of belt 23 along a normal trajectory and fall onto conveying belt 54, which carries them to subsequent processing such as weighing and packaging. Defective potato strips 20*b* are deflected into hopper 55 from which they pass to further processing steps or to waste. Rather than a separate hopper for defective strips, if the belt 54 is arranged at right angles to belt 23, the sound potato strips and the defective potato strips can be arranged on different portions of the same belt.

Figure 13:
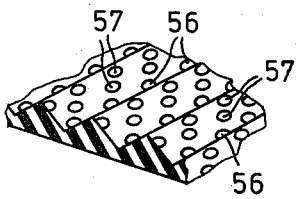

Belt 23 has a series of raised knobs 56, FIG. 13, in the bottom of grooves 33, and raised knobs 57 along the walls of grooves 33. These knobs keep the potato strip pieces from sticking to the belt by breaking any suction that might exist otherwise between the potato strip pieces and the belt if such pieces were on a smooth surfaced belt. It should be realized that these potato strip pieces are generally wet when being processed, and this adds to the suction problem. With the knobs as illustrated, a normal size potato strip will lie over several knobs. Suction cannot exist and the strips are discharged from the end of the belt in the trajectory shown. Some very short strips which are generally undesirable may stick to the belt between the knobs and tend to come off the belt in a trajectory that places them with the defective strips.

Defect Sensing Means

The presently preferred means for sensing defects is similar to that described in application Ser. No. 895,256. It is located above the viewing area, and includes means for providing both visible light energy and infrared energy to the viewing area as well as means for differentially detecting such visible light energy and infrared energy reflected from the viewing area.

Mounted on top of legs 29 is a frame comprising respective longitudinal members 60 extending parallel to belt 23 and respective crossbars 61 extending transversely of belt 23. Intermediate crossbars 61 serve to support a housing superstructure 62 having respective lower side walls 62*a*, FIG. 4, upwardly convergent upper side walls 62*b*, lower front wall 62*c*, FIG. 2, upwardly convergent upper front wall 62*d*, back wall 62*e*, and a top wall 62*f*, FIG. 4. Such walls are preferably panels of stainless steel welded at adjoining edges.

In the present embodiment, a scanning camera 63, such as the dual array, line scan camera designated LCD200 by its manufacturer Reticon Corporation, Sunnyvale, California, is used to detect the reflected visible light and infrared energies. It also provides built-in, sensed-signal comparing means. It is adjustably mounted above top wall 62*f* (FIGS. 4 and 6) of housing 62, and is desirably adjustable in several directions so that it can be focused exactly on the product carrying portion of the belt. To this end, in the illustrated embodiment, camera 63 is mounted for vertical adjustment on a camera support column 64 (see slots 64*a* and bolts 64*b*, FIG. 4) which is rigidly attached to a base plate 65. Plate 65 is mounted for rotational adjustment on a plate 66 (see slots 65*a* and bolts 65*b*, FIG. 7) which is mounted on and for lateral adjustment with respect to a plate 67 (see slots 66*a* and bolts 66*b* FIG. 7). Such plate 67 is, in turn, mounted on housing top wall 62*f* for lateral adjustment in a direction transverse to the direction of adjustment of plate 66 (see slots 67*a* and bolts 67*b* FIG. 7).

Plates 65, 66, and 67 and housing top wall 62*f* are apertured, as at 68, to provide a viewing opening covered by a pane 69 of transparent material, preferably plastic, held in place by brackets 70. A removable rectangular box-like cover 71, FIGS. 1 and 4, preferably of aluminum for good heat transfer from the camera, fits on top of housing 62 to cover and protect camera 63 and its mounting.

The front portion of the bottom of the housing 62 is closed across its width by bottom wall 72, FIG. 2, leaving the rear portion of the bottom of the housing open. A flap 73 hinged to bottom wall 72 at 74 may be pivoted into the position shown in FIG. 2 so that a portion thereof extends downwardly from the housing toward the belt and, together with the lower portion of housing rear wall 62*e*, forms a downward extension 62*g* of housing 62 for the reception of a utility unit 75 within the lower part of the space defined by such housing extension. Flap 73 may be swung into its alternate position shown by broken lines in FIG. 2 to completely close the bottom of housing 62 during cleaning of the apparatus or when utility unit 75 is not in place. Weight 76 on flap 73 holds the flap in either of its two positions. Thus, with the flap in position to close the bottom portion of housing 62, the flap remains in that position because of the action of weight 76 against rear crossbar 61. When flap 73 is in position as shown in solid lines in FIG. 2, weight 76 is on the other side of pivot axis 74 and maintains the flap in that position. Flap 73 is moved to its closed position either manually or automatically when utility unit 75 is swung outwardly, and is returned to open position manually after the utility unit 75 is in place.

Ultra high molecular weight polyethlene strips 77 and 78 are provided across the lower ends of housing rear wall 62*e* and flap 73 respectively to form a splash seal with utility unit 75 when it is in place.

An end cover 79, FIG. 4, attached to a longitudinal member 60 forms an end for the downward extension 62*g* of housing 62. The other end of the extension is open to receive the utility unit. Cover 79 has a portion 79*a*, FIGS. 1 and 2, that attaches to housing rear wall 62*e*. Flap 73 is wider than the housing so that it extend to end cover 79 at one end, FIG. 4, and, at the other end, extends along the utility unit.

Utility unit 75 has a portion 75*a*, FIGS. 1 and 4, which projects from the open end of the housing extension 62*g* and is pivotally attached to a leg 29 of the apparatus by means of a sleeve 80, which rotatably encircles the leg and is supported thereon in any suitable manner, e.g., by a collar 81 secured to the leg. In this way, utility unit 75 is swingable away from its operational position within the housing extension and across belt 23, to a position alongside the belt, where the energy radiating, i.e. lighting, fixtures within the unit can be swung out as indicated by broken lines in FIG. 14, so as to be easily accessible for maintenance. As explained, flap 73 of the housing extension swings outwardly for this purpose and closes the bottom of housing 62 during periods of maintenance.

Portion 75*a* of utility unit 75 comprises a duct arrangement, see FIGS. 4, 8, 9, and 12, for circulating cool air in a closed circuit into and from the other portion of unit 75 that fits into downward extension 62*g* of housing 62. A blower 82 is supported by the duct arrangement made up of walls 83 through 89 of such portion 75*a*, into which it forces cooling air. Hot air is returned to the blower by duct 91. An insulating space 84*a* is provided between walls 84 and 85 to lessen heat transfer from the hot air in duct 91 to the cool air in duct 90. This duct arrangement is supported by brackets 92 and 93, which are secured to and extend in cantilever fashion from sleeve 80, and by plate 94 attached to such brackets.

A motor 95 runs blower 82 by means of a belt drive 96, which is supported at the blower by a bracket arrangement 97 secured to and projecting from duct wall 83. The motor is mounted on support 89.

Figures 8, 9, 10, 11:
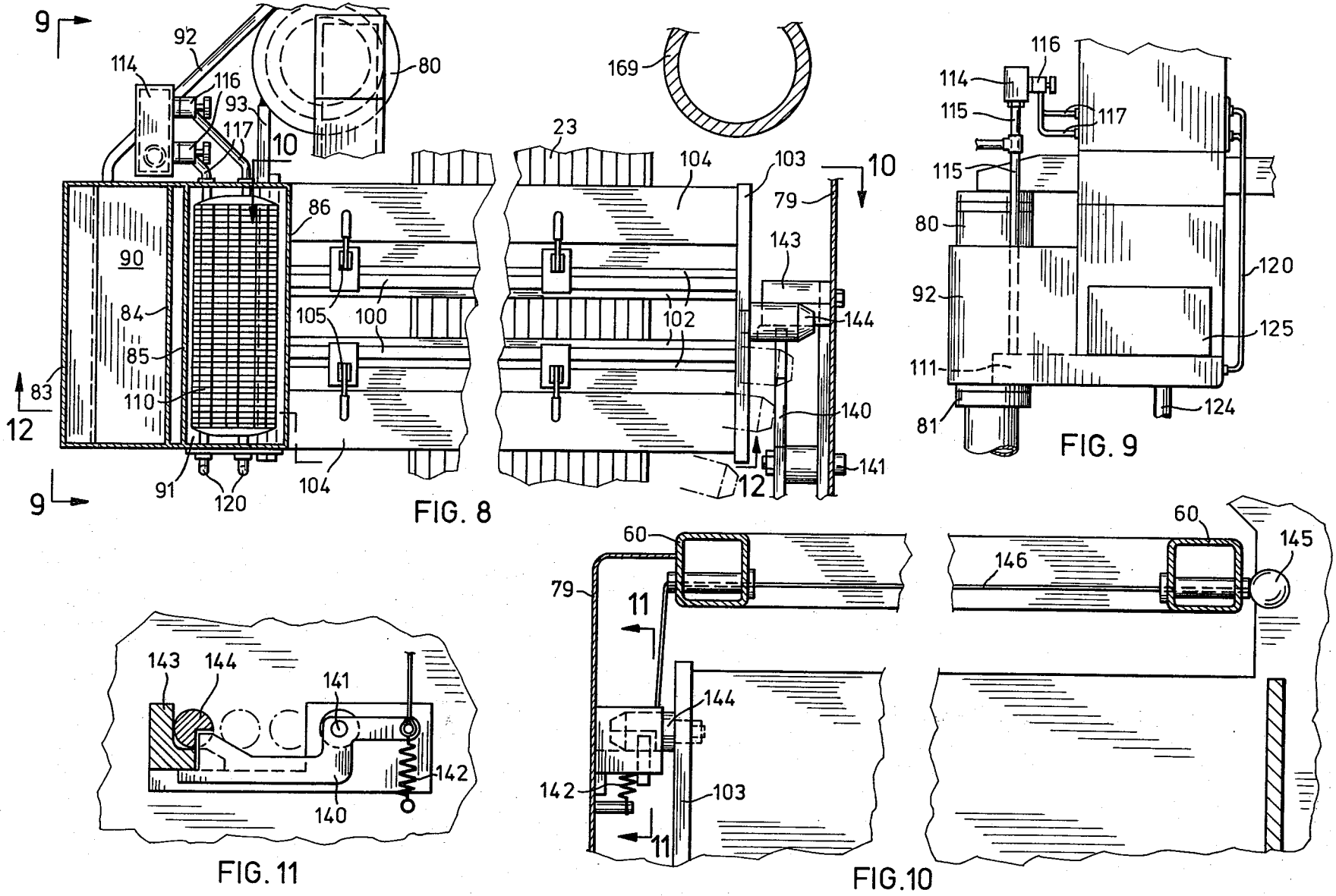
Figure 14:
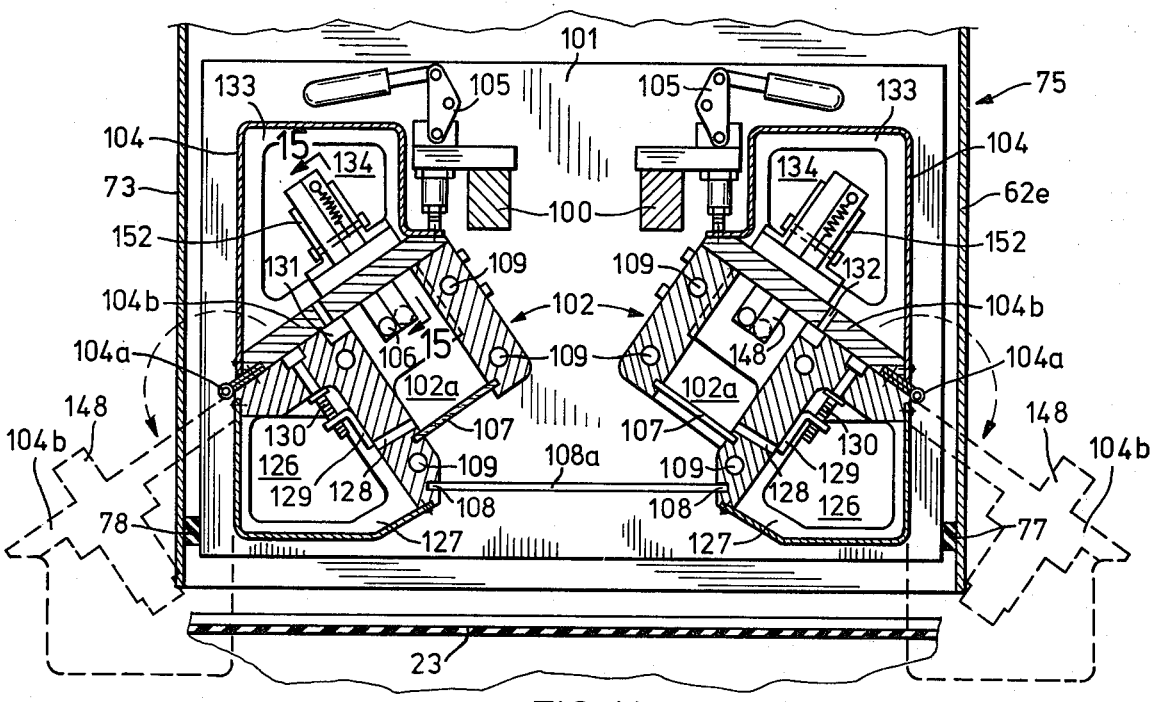
Figure 17:
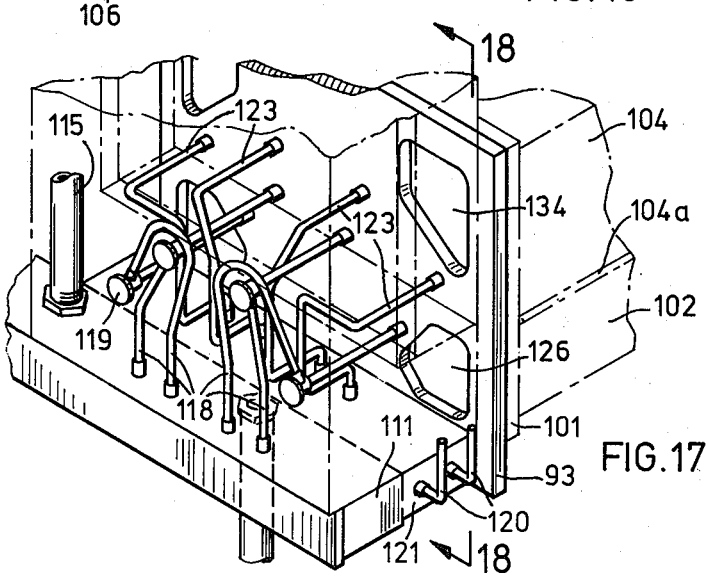

The portion of utility unit 75 that fits within downward extension 62g of housing 62 comprises structural members 100, FIGS. 8 and 14, extending in cantilever fashion from a wall 101 attached to bracket 93, FIG. 17, and further comprises elongate lamp-cooling boxes 102 extending similarly from wall 101. A plate 103, FIGS. 8 and 12, interconnects the otherwise free ends of members 100 and boxes 102 to provide structural rigidity. Such portion of utility unit 75 also includes swingable, radiant energy (i.e. light) fixtures 104 hinged at 104a but normally maintained in the positions shown in full lines tightly closing the open tops of boxes 102, by means of clamps 105. Operably fitted into electrical sockets of light fixtures 104 are electrical lamps 106, which are preferably of quartz iodine type so as to produce a substantial output of both visible light energy and infrared energy. Eight lamps, each of 1500 watt rating, such as General Electric type Q1500T3/CL, have been found to produce satisfactory output for purposes of the invention. The lamps are staggered in position along the length of each fixture, as explained hereinafter with reference to FIG. 15, so as to provide substantially uniform illumination along the length of viewing area 21 toward which the visible light energy and the infrared energy from lamps 106 are directed in the normal working positions of fixtures 104. Clear plastic panes 107, FIG. 14, are provided along the otherwise open bottoms of the respective lamp-cooling boxes 102 to guard against glass, from possible lamp breakage, falling into the potatoes moving through viewing area 21. Grooves 108, perpheral to the open bottom of utility unit 75, and a groove 108a across wall 101 are advantageously provided for receiving and holding a protective panel (not shown) across such open bottom during cleaning of the apparatus.

For replacing lamps 106 and for other maintenance work, light fixtures 104 may be swung outward into accessible position (indicated by broken lines in FIG. 14), when utility unit 75 is itself swung outwardly on its pivot axis (leg 29) as previously described. It should be realized that FIG. 14 shows the lighting unit in its working position within downward extension 62g of housing 62 and that the broken line position of lighting fixtures 104 are assumed only after such lighting unit is swung to its maintenance position for servicing. Conveyor side wall pieces 52 must be pivoted out of normal position along belt 23 before utility unit 75 can be swung outwardly.

The electric lamps specified have a normal operating temperature of approximately 600° F. In the closed environment of utility unit 75, the temperature could easily exceed such operating temperature thereby damaging the lamps if cooling is not provided. Moreover, although a heat-resistant plastic, such as Rohm and Haas "Tuffak," is used for the protective panes, the temperature attained by such plastic should not exceed about 270° F. during operation over extended time periods. It is normal for the apparatus of the invention to operate over extended time periods. Accordingly, forced air cooling is provided.

Cooling air is circulated through lamp-cooling boxes 102 and light fixtures 104 from blower 82 by way of duct 90, and a coolant, such as cold water at about 65° F., is circulated through passages 109 in the walls of the light-cooling boxes 102 from any suitable source of same, e.g. the water supply system of the processing plant utilizing the apparatus. As shown, blower 82 pulls air from duct 91 and blows it into and through duct 90. Duct 91 contains a heat exchanger 110, see particularly FIG. 12, which is conveniently formed by mounting two automobile heater cores one on top of the other for circulation of a coolant, such as cold water, from a circulatory system that also supplies coolant to the flow passages 109 of lamp-cooling boxes 102.

Figure 12:
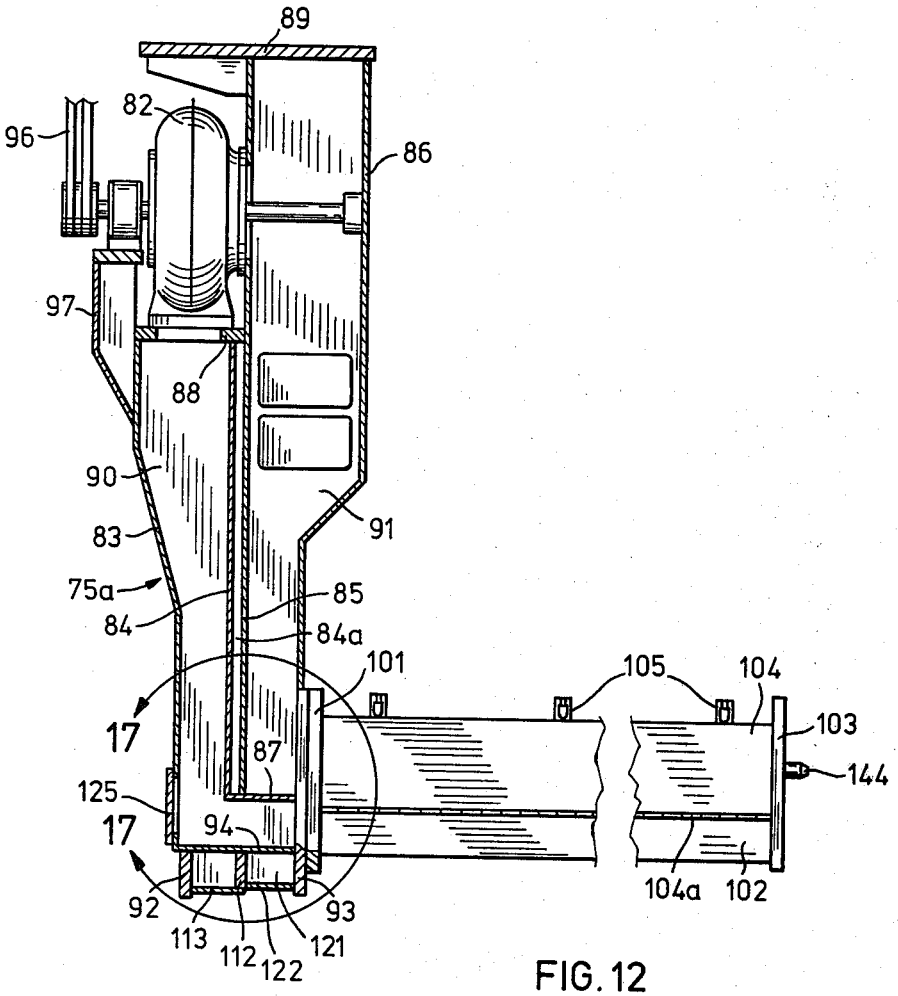
Figure 18:
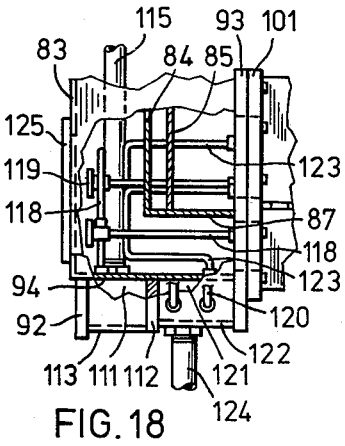

The circulatory system includes a main utility unit, coolant input manifold 111, FIGS. 17 and 18, formed by a portion of bracket 92, plate 94, divider 112 and bottom plate 113, FIG. 12, and a heat exchanger, coolant input manifold 114, FIGS. 8 and 9. Such manifolds are supplied with coolant by a supply pipe 115, FIG. 9. Valves 116 and piping 117, FIG. 8, supply heat exchanger 110, and piping 118, FIG. 17, with valves 119 supply the flow passages 109, FIG. 14, through the walls of the lamp-cooling boxes 102, FIG. 12. Exhaust coolant from heat exchanger 110 flows through piping 120 to a coolant exhaust manifold 121, formed by a portion of bracket 93, plate 94, divider 112, and bottom plate 122. Exhaust coolant from flow passages 109 flows through piping 123 to the same exhaust manifold 121. The coolant is exhausted from manifold 121 through drain pipe 124. A cover 125 covers an opening in wall 83 which, when removed, allows access to valves 119 for adjustment. It should be realized that coolant supply line 115 and coolant exhaust line 124 will be coupled with flexible hose to the coolant supply and exhaust in the plant so that utility unit 75 can pivot on its axis.

The cooled air forced by blower 82 into duct 90 flows through openings 126, FIGS. 14 and 17, in wall 101 and bracket 93, into respective ducts 127, FIG. 14, which extend along the length of the portion of the utility unit that fits within downward extension 62g of housing 62 and from which the cool air flows through respective series of slots 128 across plastic panes 107 and into and along chambers 102a within lamp-cooling boxes 102. Air flow through each slot 128 may be adjusted by moving adjustment stop 129 with screw 130 so that it blocks more or less of respective slots 128. In this way, flow of air through each slot can be adjusted to be substantially equal regardless of the distance of the slot from the source of cool air. The cool air suffuses about lamps 106 and flows up into respective ducts 131, FIG. 14, in light fixtures 104 through respective series of mating passages 132 in the lamp-cooling boxes 102 and light fixtures 104, respectively, to duct 133 in light fixture 104. From ducts 133, the now heated air returns to duct 91 through corresponding openings 134, FIGS. 14 and 17, in wall 101 and bracket 93, where it is recooled and recirculated.

Air vents 135, FIGS. 1 and 4, are preferably provided in the upper part of housing 62 to ventilate the interior of the housing.

End wall 79 contains a latching mechanism, FIGS. 8, 10, and 11, comprising a latch member 140 pivotally mounted on pin 141. Spring 142 urges latch member 140 to a position against support member and stop 143. When utility unit 75 is swung into position in housing extension 62g, latching member 144 secured to utility unit end plate 103, FIG. 8, moves against and is supported by stop 143. Latching member 140 is moved against the bias of spring 142 as latching member 144 moves against the stop and then snaps back into latching position as shown in FIG. 11 to lock utility unit 75 in place. To unlatch the utility unit so that it can be swung into maintenance position, knob 145, located on the side of the apparatus away from the latch and attached to cable 146, is pulled, which pivots latch member 140 against the bias of spring 142, and releases latch member 144.

Special Lamp Holders

Figure 15:
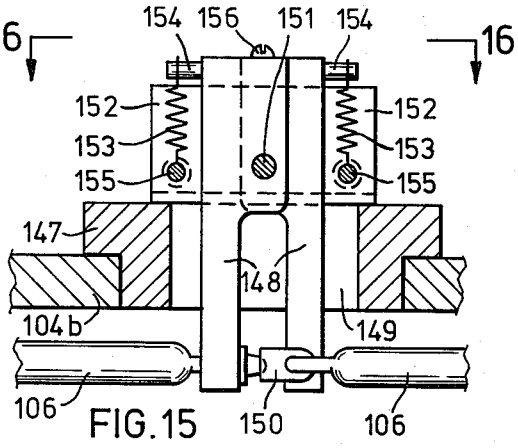
Figure 16:
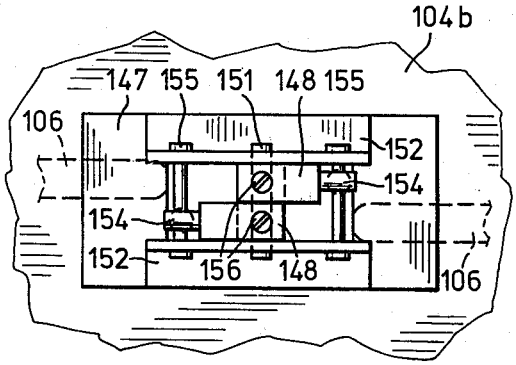

Although commercial lamp holders of various kinds could be used in the apparatus, it is preferred that they be specially constructed, as is illustrated with light fixture 104, FIGS. 14, 15, and 16.

Insulating ceramic blocks 147 are positioned to rest on, and extend through respective openings in, the lower wall 104*b* of each such light fixture 104. For each block 147, mutually offset bus bars 148 extend through a central opening 149 in the block and support respective, electrical, lamp-holding contactors 150 in similarly offset positions. Bus bars 148 are pivotally mounted in common on a pivot pin 151 which extends between mutually spaced structural angles 152 that are secured to and rise from the upper surface of insulator block 147.

Each bus bar 148 is resiliently biased by a coil spring 153 having one end attached to an arm 154, extending from the upper end of the corresponding bus bar 148 at the opposite side thereof from that which carries the holding contactor 150, and having the other end attached to a corresponding pin 155 secured between structural angles 152. Thus, the lower end of the bus bar and the socket 150 carried thereby are constantly urged toward the lamp 106 that is fitted into the socket and a good electrical connection is assured at all times. An electrical terminal 156 is provided on each bus bar for connection to a power supply.

As so constructed, the lamps 106 may be arranged very closely together with their ends overlapping, so that there is only a small break between the light producing portions thereof. This helps to provide an even spread of radiant energy through the viewing area. It is preferred to arrange the lamp-holding contactors and lamps in this way, at opposite sides of the center of utility unit 75. At the ends of the utility unit, however, there will be only one lamp-holding contactor and the fixtures will be modified accordingly. At the center of the utility unit, it has been found satisfactory to not have the overlapping arrangement. Accordingly, the lamp-holding contactors 150, are positioned at respectively opposite sides of the bus bars. At the ends of the unit and at the center, the bus bars are not resiliently mounted. Thus, the springs are removed and an additional pin is placed through the bus bars so that they do not pivot. The resilient lamp holders as shown are placed between the center holder and end holders and provide the needed resilience for lamp replacement and good contact.

In all arrangements, the sockets are wired so that electric current flows through the lamps from the socket at one end of the lamp to the socket at the other end thereof.

Means for Removing Defective Items

The means for removing those cut potato strip pieces 20 which contain dark spots indicative of defects comprise a series of removal devices and respective operating devices therefor, shown generally at 160, FIGS. 1 and 2. Such removal devices are arranged contiguously as a series extending transversely across the discharge area of belt 23 downstream from viewing area 21 and directly above removal area 22. They are mounted on support plate 161, secured to side plate 162 which is pivotally secured to side plate 163 at 164 for rotational adjustment, see slots 162*a* and bolts 162*b*, FIG. 20. Side plate 163 is mounted for horizontal adjustment on plate 165 by means of a slideway formed by slide pieces 166 and 167 which are secured to plate 165 and which, when tightened, hold plate 163 securely in relation to plate 165. Plate 165 is mounted for height adjustment on plate 168, see slots 165*a* and 165*b*, FIG. 20. Plate 168 is mounted on sleeve 169 so that the whole removal means can be rotated away from the removal area. Sleeve 169 encircles a leg 19 and is supported by collar 170. Bar 171 strengthens support plate 161 and keeps it rigid.

Figure 19:
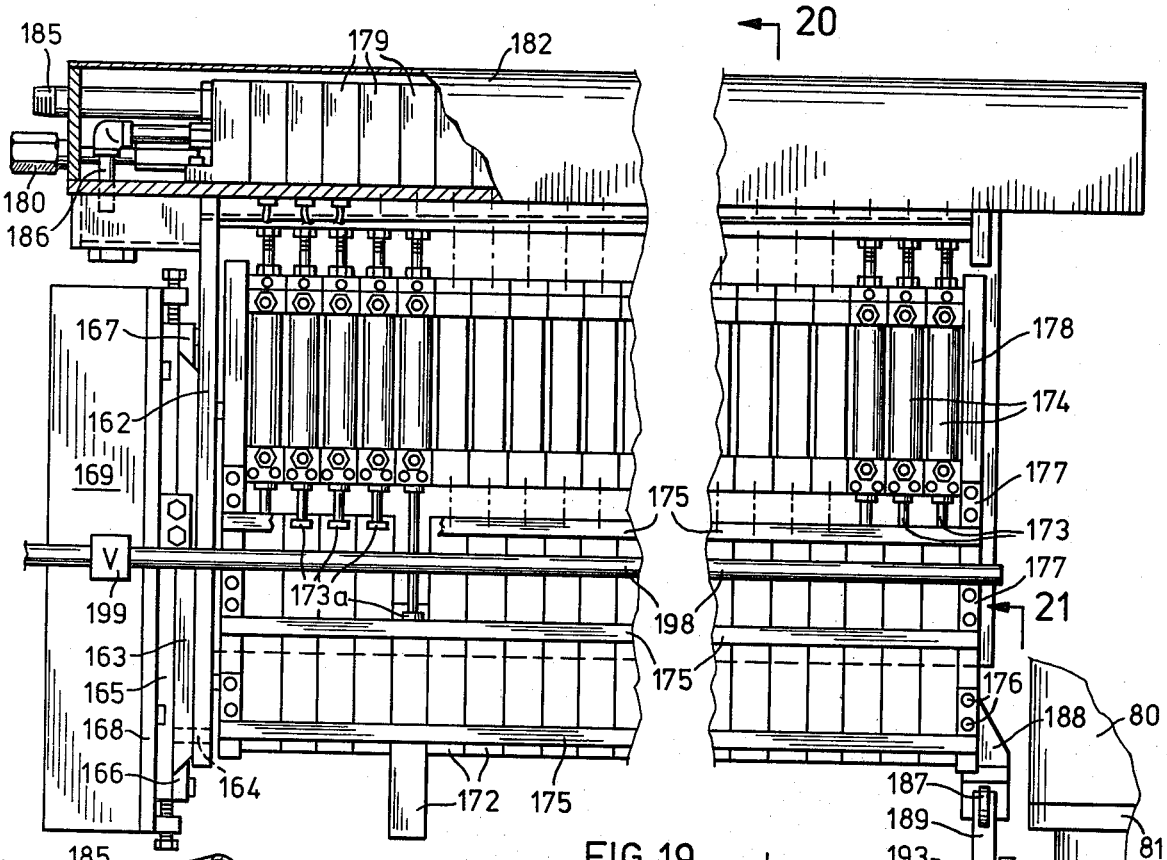
Figure 20:
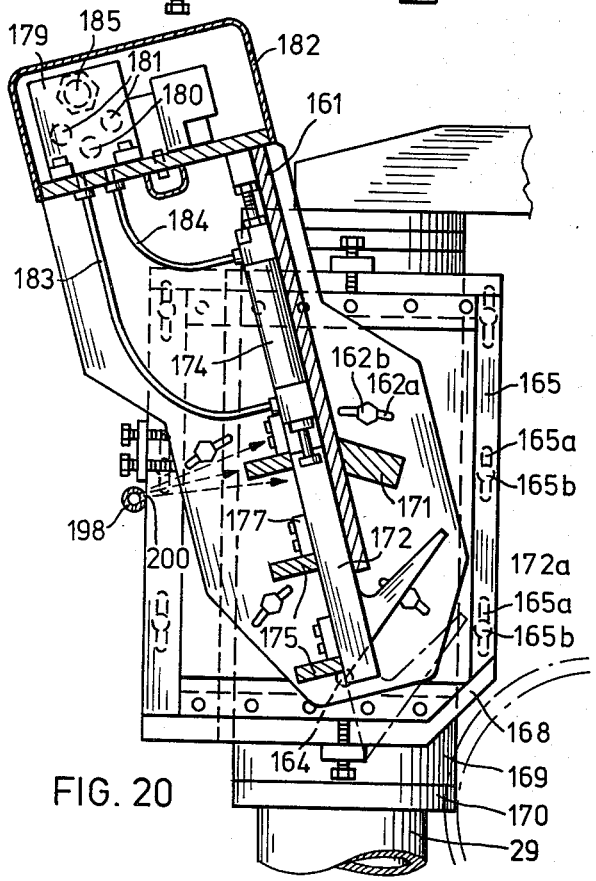

In the form illustrated, the removal devices are potato strip deflectors 172, FIGS. 19 and 20, square in cross section and normally held above removal area 22 which comprehends the area of normal trajectory of potato pieces 20 from the end of belt 23, FIGS. 1 and 2, by respective piston rods 173 of pneumatically operated cylinder and piston assemblies 174 constituting the operating means. The piston rods have headed lower ends 173*a*, which slide into corresponding receiving slots formed in the upper ends of the respective deflectors 172, such upper ends being solid as shown. Thus, the deflections are separable from the pistons to facilitate assembly and disassembly and replacement.

As shown, the potato strip deflectors 172 are slidably mounted between support plate 161 and guide bars 175 for movement under the control of cylinder and piston assemblies 174, respectively. Guide bars 175 are secured together in properly spaced relationship by bolts 176 passing through brackets 177 and marginal spacer strips 178 laterally of the assembled deflectors. The cylinder and piston assemblies 174 are attached to support plate 161.

Deflectors 172 are preferably made of an ultra-high molecular weight polyethylene plastic to provide durability with light weight and to be capable of sliding easily on the guide bars and support plate between which they are positioned. The deflectors are preferably partially hollow to further reduce weight. The light weight is important, so as to minimize load and impact stress on the cylinder and piston assemblies during movement of the deflectors, which is very rapid.

Deflectors 172 and cylinder and piston assemblies 174 are arranged so that piston rods 173 are normally withdrawn into their cylinders. The lower ends of deflectors 172 each have a shoe 172*a* so that a flat surface is formed at an angle to the deflector. When a deflector is lowered into the trajectory of potato pieces from belt 23, the potato pieces striking the deflector shoe will be deflected by the angled surface into bin 55 as shown in FIGS. 1 and 2. The shoe 172*a* must extend from deflector 172 far enough so that potato pieces will not strike any portion of the deflector other than its angled shoe surface.

Cylinder and piston assemblies 174 are preferably actuated pneumatically under the control of electrically controlled, pneumatic valves 179. Such valves 179 may be pilot-operated, spool type (manufactured by Mac Vales Incorporated under Model No. 811B-611D-142) designed to operate on twenty four volts DC and ganged together with a common inlet 180 for pressurized air and a common exhaust 181. As shown, they are protectively mounted in a housing 182.

A series of air supply lines 183 and 184 connect valves 179 with the cylinder and piston assemblies 174, respectively. Electrical wiring from the control circuitry extends through conduit 185 and connects with the respective valves. Air is exhausted through pipe 186.

Figure 21:
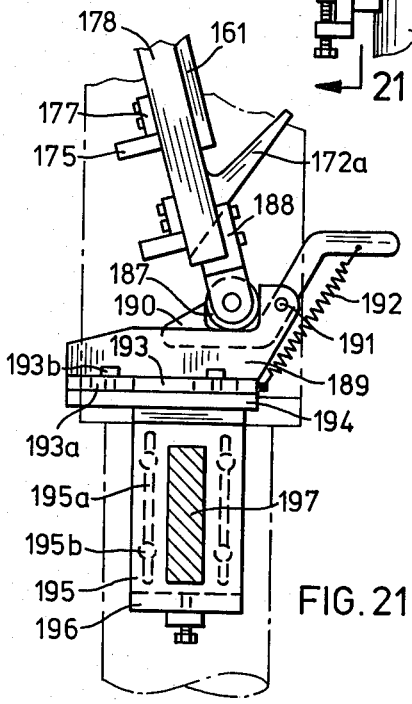

As mentioned, the whole removal means assembly is mounted so that it can be swung about leg 29 out of its working position to a position away from belt 23. To secure the assembly in its working position, a roller 187 is secured to bracket 188, FIGS. 19 and 21, which is secured to a marginal spacer strip 178 at the bottom of the assembly opposite the end where it is mounted to leg 29. A locking mechanism is secured to the opposite leg 29 and comprises a runway 189 for roller 187 and latch member 190 pivotally mounted at 191 and urged by spring 192 into latching position shown in FIG. 21. To release the assembly, latch member 190 is moved against spring 192 so that roller 187 may move along and off runway 189.

The latching assembly is height adjustable so that it will help support the assembly at the proper height, and horizontally adjustable to accurately position the removal means in the removal area. Runway 189 is secured to plate 193 which is horizontally adjustably mounted on plate 194, see slots **193*a* and bolts 193*b***.

Plate 194 is secured to plate 195 which is mounted for vertical adjustment on plate 196, see slots **195*a* and bolts 195*b*. Plate 196 is secured to leg 29 with a spacer 197** therebetween.

To reduce starch build up and keep the deflector assemblies lubricated, food grade vegetable oil is sprayed periodically, e.g. every 30 minutes, onto the piston rods 173 and deflectors 172. For this purpose an oil line 198, FIGS. 19 and 20, is connected through a valve 199, preferably an electrically controlled valve that can be operated automatically at regular intervals, to a source of pressurized vegetable oil. Oil line 198 has a series of openings 200 along its length which serve as nozzles to spray the oil against the piston rods and deflectors as shown by arrows in FIG. 20.

General Arrangement and Operation Control

The system is designed for use in sorting the elongate items that are substantially singulated and aligned on the belt. Although various types of sensing systems can be used to determine if defects are present in the items passing through the viewing area, and for operating the removal means when defects are found, it is preferred that the system as described in the above-reffered-to application Ser. No. 895,256 be used. The details of the operation of that system are hereby incorporated by reference into this application, and are only summarized briefly herein.

As previously indicated, in the illustrated embodiment the belt is thirty-five inches wide and the cut potato strip pieces 20 are deposited onto an intermediate thirty-two inches of the belt width. The field of view of camera 63 is adjusted to span the total width of the item carrying portion of the belt as it passes through viewing area 21.

Each of the two linear diode arrays of the "Reticon" dual array, scanning camera contains one thousand and twenty-four light sensitive diodes. The diodes of one array are arranged to detect visible light energy in the range of wavelengths from 400 to 700 nanometers. The diodes in the other array are arranged to detect infrared energy in the range of wavelengths from 900 to 1100 nanometers. The two arrays are precisely set up, so that corresponding diodes of each array (diode pairs) are focused on exactly the same small portion of the viewing area and produce respective signals for comparison with each other to determine whether or not a predetermined relationship therebetween, indicative of a dark spot defect, exists. The diode pairs are arranged side-by-side, so as to focus on respective contiguous sub-areas of viewing area 21 extending serially across the width of belt 23. The particular camera utilized in this embodiment of apparatus has a seventy-five millimeter lens and is positioned so that the distance from the lens to the potato pieces in the viewing area is approximately ninety-four inches.

Camera 63 senses only those portions of the visible light energy and infrared energy from lamps 106 which are reflected to it from the viewing area. Potato strips 20 that are sound and without defect reflect substantial amounts of both visible light energy and infrared energy and do so in a constant proportion. Belt 23 is made so as to reflect the visible light energy and infrared energy in the same proportion. Accordingly, the camera does not distinguish between the energy reflected from sound potato pieces and the enrgy reflected from the belt. However, visible light energy and infrared energy are reflected in much different proportion by dark defective spots in the cut potato pieces than by the white, sound potato flesh. Generaly speaking a defect will reflect much less visible light energy than it does infrared energy and much less visible light energy than does a sound potato piece. Thus, if the amount of reflected visible light energy is at least a predetermined amount less than the reflected infrared energy, a defective potato piece is indicated.

In the particular embodiment concerned, each diode will observe a linear distance of one thirty-second of an inch. Thirty-two of the diodes will observe an inch of belt width. Potato deflectors 172 are each one inch in width. The distance from ridge to ridge of the grooves 33 in belt 23 are one inch. Therefore, each deflector 172 corresponds to a belt groove 33 and, when operated, will deflect potato strips passing from the corresponding groove. Since the positions of the potato strip pieces 20 across the width of the removal area 22 are the same as the positions across the width of the belt as they pass through viewing area 21, each of the removal deflectors will be controlled by a corresponding plurality (thirty-two) of diode pairs viewing a corresponding plurality (thirty-two) of sub-areas of the viewing area, each sub-area corresponding to a groove in the belt, and will remove a corresponding one inch portion of the width of the potato strips passing through the removal area a predetermined time, depending upon conveyor belt speed, after the reflected energy from the potato strip or strips in that groove of the belt is sensed and indicates that such strip or strips should be removed.

The "Reticon" camera preferred for use in connection with this invention includes electronic components and circuitry for comparing signals produced by each diode pair and for producing a resultant data signal when the comparison shows a predetermined relationship indicative of a defect in the viewed potato piece. The control circuitry forming a part of the present invention may be arranged to activate any of the deflector operating devices upon receiving a predetermined number, one or more, of data signals for that removal tube.

The system electronics as described in the referenced Application No. 895,256, utilized a signal from a belt speed encoder which is indicative of the speed of belt 23. To produce such signals, a belt speed encoder 201, FIG. 1, is mounted at the end of the shaft of the idler tail roller of the conveyor.

Recapitulation

From the above, it will be realized that the apparatus of the invention comprises conveying means for passing slender, elongate strip pieces through a viewing area for detecting defects therein and then through a removal area for separating defective pieces from the sound pieces. The conveying means includes a conveyor, preferably a shaker feeder, adapted to receive such pieces randomly oriented in a flow of same from any suitable source, and a second conveyor of belt type arranged as a longitudinal continuation of the first conveyor. The former has upstanding walls defining a series of side by side channels extending longitudinally thereof along the direction of materal travel in substantially singulated end to end alignment. The bottom of each channel is preferably formed as two troughs extending longitudinally with the channels, as illustrated and the second conveyor has a series of troughs aligned longitudinally with the series of channels of the first conveyor and with the multiple troughs of such channels, so that the strip pieces are carried through the viewing and removal areas in substantially singulated and aligned end to end arrangement.

Whereas this invention is here illustrated and described with specific reference to an embodiment thereof presently contemplated as the best mode of carrying out such invention in actual practice it is to be understood that various changes may be made in adapting the invention to different embodiments without departing from the broader inventive concepts disclosed herein and comprehended by the claims that follow.

We claim:

1. Apparatus for sorting slender elongate items, some of which are defective, comprising means defining a viewing area; means associated with said viewing area for sensing defects in such items and signalling when a defect is sensed, said sensing means including a plurality of paired sensing devices focused on the viewing area so as to view corresponding contiguous sub-areas of said viewing area; means defining a removal area; conveying means for passing the items through said viewing area and said removal area, including a conveyor adapted to receive the items randomly oriented in a flow of such items, said conveyor having upstanding walls defining a series of side by side channels extending longitudinally thereof along the direction of item travel for receiving said items and placing them in substantially singulated end to end alignment, and a second conveyor of endless belt type arranged as a longitudinal continuation of the first conveyor and having a series of troughs aligned longitudinally with said series of channels for receiving the singulated and aligned items from the channels of the first conveyor and for carrying the received items through said viewing area and into said removal area in substantially singulated end to end alignment, the width of each of the troughs of the belt conveyor comprehending a plurality of said sub-areas, and said paired devices being adapted to sense the two different wavelength bands, respectively, of energy reflected from the corresponding sub-areas; means for flooding the viewing area with radiant energy containing two mutually different wavelength bands in a substantially integrated spread throughout said viewing area; means for comparing the sensed radiant energy of one wavelength band with the sensed radiant energy of the other wavelength band from each sub-area of said viewing area and for producing data signals, respectively, for those sub-areas as to which the predetermined relationship between the sensed energy of different wavelength bands exists; means associated with said removal area for removing those items identified as defective by signals from the sensing means, said removal means including a plurality of removal devices arranged in side-by-side relationship across the width of the removal area so as to comprehend respective troughs of the belt conveyor whose widths correspond to a plurality of said contiguous sub-areas of the viewing area; and operating means responsive to data signals, for independently operating the removal devices in accordance with a predetermined number of data signals produced for respective corresponding pluralities of contiguous sub-areas of the viewing area, so as to remove from the items carried by the belt conveyor those which have produced the predetermined number of data signals.

2. Apparatus according to claim 1, wherein the bottom of each channel of the first conveyor is formed as multiple troughs extending side by side longitudinally with the channel.

3. Apparatus according to claim 2, wherein the bottom of each channel is formed as two troughs.

4. Apparatus according to claim 1, wherein the first conveyor is a shaker conveyor.

5. Apparatus according to claim 4, wherein selected walls of the first conveyor have fingers extending upwardly therefrom for bringing misaligned items received by said coveyor substantially into alignment with the channels.

6. Apparatus according to claim 4, wherein the shaker conveyor has two feeder trays, an upper one for receiving the randomly oriented items in a flow of such items, and a lower one provided with the upstanding walls and the channels defined thereby.

7. Apparatus according to claim 6, wherein the channel defining walls extend beyond the lower feeder tray and overhang the adjacent end of the endless belt conveyor.

8. Apparatus according to claim 1, wherein the means for removing defective items comprises a side by side series of deflectors extending transversely of the endless belt conveyor adjacent its discharge end, each of said deflectors substantially corresponding in width and location to one of the troughs of said belt conveyor but normally positioned out of said troughs; and means for interposing one or more of said deflectors in the flow line of the corresponding trough or troughs in response to respective signals from the

9. Apparatus according to claim 1, wherein the belt of the endless belt conveyor is of corrugated formation so that the corrugations of its working surface provide the side by side troughs extending longitudinally of the belt, and an idler roller formed to mate with the corrugations of said belt is provided to keep the belt aligned.

10. Apparatus according to claim 1, wherein means are provided for operating the endless belt conveyor at a faster speed than the first conveyor.

11. Apparatus according to claim 1, wherein a series of knobs are provided on the working surface of the endless belt so that most of the items on the belt rest on at least one knob, thereby preventing such items from sticking to the belt.

* * * * *

UNITED STATES PATENT OFFICE

CERTIFICATE OF CORRECTION

PATENT NO. : 4,385,700

DATED : May 31, 1983

INVENTOR(S) : Joseph L. Hodges, Norman B. Wassmer; Paul R. Myers

It is certified that error appears in the above-identified patent and that said Letters Patent are hereby corrected as shown below:

Column 16, line 53, following "from the", insert --defect sensing means.--

Signed and Sealed this

*Second* Day of *August 1983*

[SEAL]

*Attest:*

GERALD J. MOSSINGHOFF

*Attesting Officer*

*Commissioner of Patents and Trademarks*